US009382711B2

(12) United States Patent
Klassy et al.

(10) Patent No.: US 9,382,711 B2
(45) Date of Patent: Jul. 5, 2016

(54) CONNECTION SYSTEM FOR JOINING RECTANGULAR WALL FRAMES

(75) Inventors: Aaron Klassy, Fond du Lac, WI (US); Robert J. Glenn, II, Chicago, IL (US)

(73) Assignee: Mayline Company, Inc., Sheboygan, WI (US)

( * ) Notice: Subject to any disclaimer, the term of this patent is extended or adjusted under 35 U.S.C. 154(b) by 0 days.

(21) Appl. No.: 13/241,899

(22) Filed: Sep. 23, 2011

(65) Prior Publication Data

US 2013/0074439 A1 Mar. 28, 2013

(51) Int. Cl.
*E04B 1/38* (2006.01)
*E04B 2/74* (2006.01)

(52) U.S. Cl.
CPC ..... *E04B 2/7425* (2013.01); *E04B 2002/749* (2013.01)

(58) Field of Classification Search
CPC ..... E04B 2/72; E04B 2002/725; E04B 2/74; E04B 2/7407; E04B 2002/7446; E04B 2002/7494; E04B 2/7818; E04B 2002/749; E04B 2/7425; E04B 2/7422; E04B 2/7448; Y10T 403/4602; Y10T 403/4674; Y10T 403/4677; Y10T 403/4681; Y10T 403/4682; Y10T 403/4685
USPC ..... 52/238.1, 239
See application file for complete search history.

(56) References Cited

U.S. PATENT DOCUMENTS 2,687,859 A * 8/1954 Arnold ..... B61L 5/10 246/452
3,073,593 A * 1/1963 Bauer ..... B21D 43/02 271/233
3,304,683 A * 2/1967 Ferreira ..... E04B 2/58 256/24
3,884,002 A * 5/1975 Logie ..... E04B 1/6162 312/263
4,012,880 A * 3/1977 Logie ..... E04B 1/6141 52/127.12
4,100,709 A * 7/1978 Good ..... E04B 2/7427 160/135
4,204,375 A * 5/1980 Good ..... E04B 2/7425 403/262
4,505,085 A * 3/1985 Oliver ..... E04C 2/40 52/582.1
4,545,142 A * 10/1985 Whisnant ..... E04B 2/7425 40/605
4,567,698 A * 2/1986 Morrison ..... A47B 83/001 160/135
4,625,476 A * 12/1986 Shimada ..... E04B 2/7409 52/126.4
4,667,450 A * 5/1987 Stefnik ..... E04B 2/7409 52/238.1
4,852,317 A * 8/1989 Schiavello ..... E04B 2/7424 52/239
4,947,601 A * 8/1990 McGuire ..... E04B 2/7425 52/239
5,211,502 A * 5/1993 Upham-Hill ..... E04B 2/7425 160/229.1

(Continued)

OTHER PUBLICATIONS

Mayline Company, Part Drawing for End Cap insert; Aug. 7, 2001.

*Primary Examiner* — Brian Glessner
*Assistant Examiner* — Gisele Ford
(74) *Attorney, Agent, or Firm* — Nixon Peabody LLP

(57) ABSTRACT

A connection system for joining rectangular wall frames fabricated from pairs of rectangular cross section tubular side frame members and rectangular cross section tubular top and bottom frame members utilizes identical connectors, such as a single size machine screw and identical threaded inserts to provide upper and lower interconnections. Three different interconnections can be made using the single size machine screw and insert, the latter inserted into the open upper ends of the rectangular cross section tubular side frame members. Frame closure panels can be attached in a simple and secure manner.

14 Claims, 8 Drawing Sheets

(56) References Cited

U.S. PATENT DOCUMENTS 5,474,402 A * 12/1995 Wu ..... E04B 2/7425 256/25
5,546,718 A * 8/1996 Way ..... E04B 2/7448 160/135
5,857,304 A * 1/1999 Karten ..... G09F 15/0068 403/325
6,151,852 A * 11/2000 Linn ..... E04H 17/163 256/24
6,295,764 B1 * 10/2001 Berridge ..... E04B 2/7425 160/135
6,389,773 B1 * 5/2002 Reuter ..... E04B 2/7425 160/135
6,503,020 B1 * 1/2003 Mascioletti ..... E04B 1/2604 403/231
2004/0045225 A1 * 3/2004 Weiss ..... E04H 1/125 52/36.1
2004/0190987 A1 * 9/2004 Yang ..... E04B 2/7425 403/348
2005/0265778 A1 * 12/2005 Tzeng ..... F16B 12/52 403/231
2006/0174563 A1 * 8/2006 Fumagalli ..... E04H 17/163 52/239
2007/0125016 A1 * 6/2007 Yu ..... E04B 2/7425 52/220.7
2008/0066413 A1 * 3/2008 Gosling ..... E04B 2/7425 52/578
2008/0104922 A1 * 5/2008 Glick ..... E04B 2/7425 52/630
2011/0005692 A1 * 1/2011 Jensen ..... A47F 5/108 160/135
2011/0099921 A1 * 5/2011 Fitzgerald ..... E04B 2/7425 52/127.1
2011/0107696 A1 * 5/2011 Preiss ..... E04B 2/7422 52/238.1
2011/0271630 A1 * 11/2011 Kadzban ..... E04B 2/7424 52/582.1

* cited by examiner

CONNECTION SYSTEM FOR JOINING RECTANGULAR WALL FRAMES

BACKGROUND

Many types of modular enclosures for commercial and industrial use utilize modular rectangular frames of varying sizes to provide support for wall panels, shelving, work surfaces and the like. The modular frames may be interconnected to provide extended length walls, countertops or shelves. These variations may require special connections along the length of an extended wall or at right angle corners. All of these variations in the modular construction often require special fasteners of varying sizes and types resulting in complex and difficult to assemble modules.

SUMMARY

In accordance with the disclosure herein, a connection system for joining rectangular wall frames that are fabricated from pairs of rectangular cross section tubular side frame members and tubular top and bottom frame members utilizes identical connectors that comprise a single size machine screw and identical inserts with coaxial threaded bores on opposite ends. The main interconnections utilize only abutting side frame members, the connecting cross frame members being of a slightly smaller cross section. The results are simple interconnections that provide significant savings in assembly time and cost. The rectangular wall frames carry easily assembled wall panels that are slid vertically into place between the vertical side frame members of a wall frame. The tubular top and bottom frame members are welded to the vertical side frame members and, for larger wall frames, an intermediate horizontal frame member may be utilized.

The wall frames may be closed on either or both of their inner and outer faces with closure panels that are easily inserted through a vertical slot between the side frame members and the top and bottom frame members.

DETAILED DESCRIPTION OF THE SEVERAL EMBODIMENTS

Figure 1:
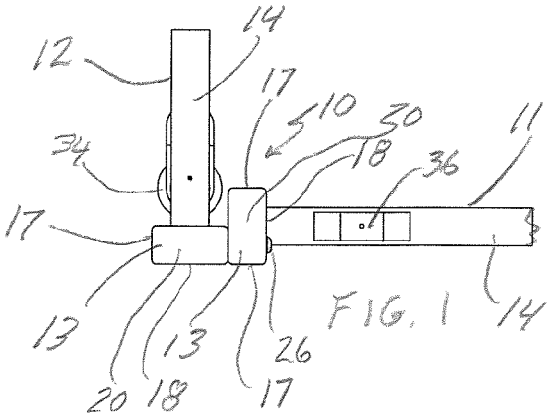
FIGS. 1-3 are top plan views of each of the three side frame interconnections used for joining the rectangular wall frames.
Figure 5:
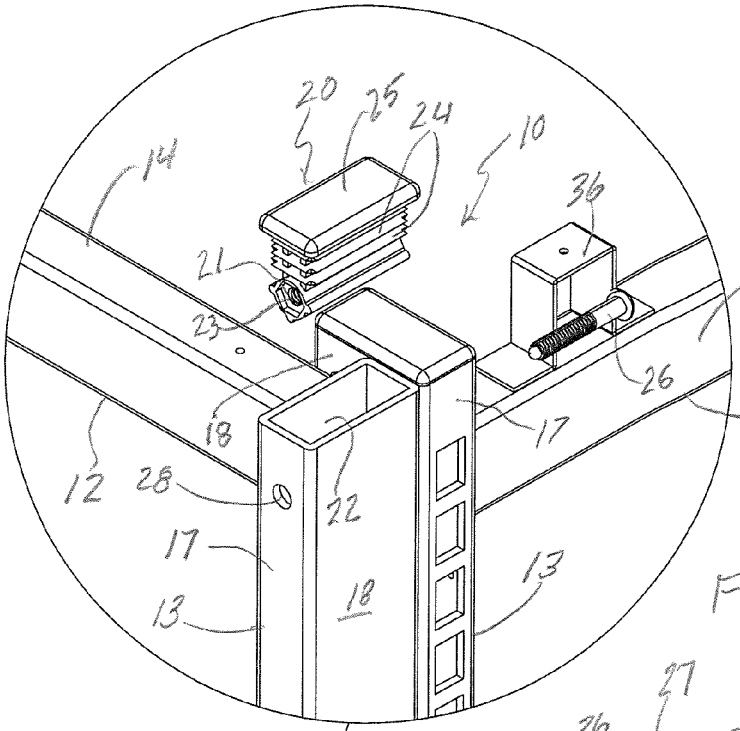
FIG. 5 is an enlarged detail of the connection shown in FIG. 4.
Figure 4:
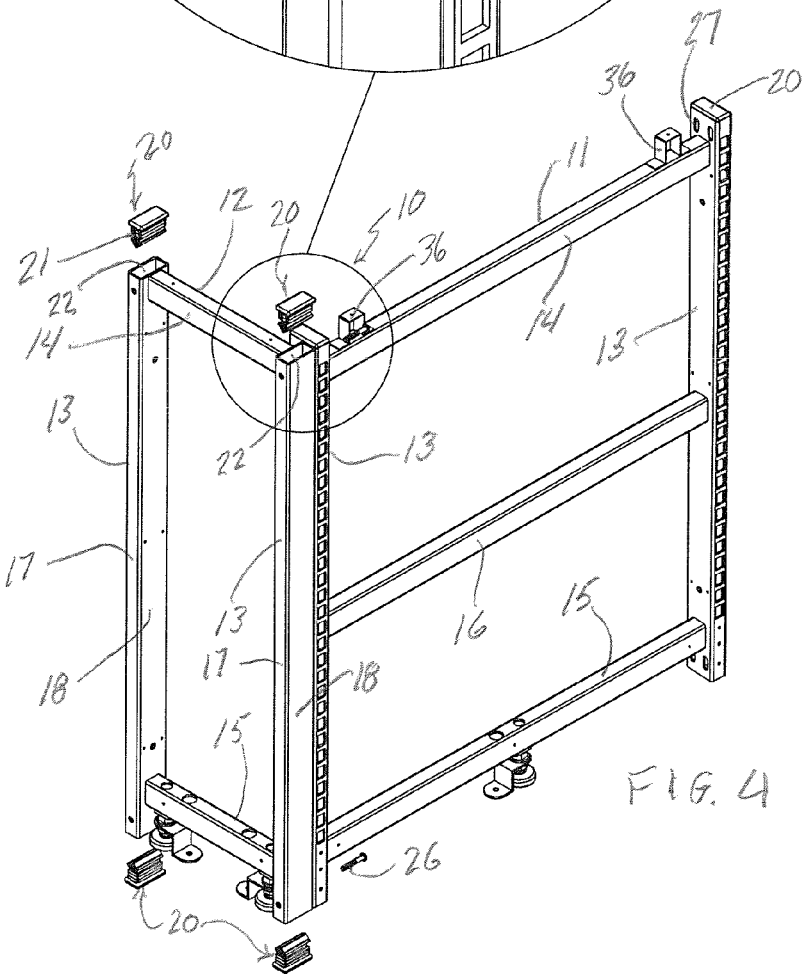
FIG. 4 is a perspective view of a subassembly of wall frames using the FIG. 1 interconnection.

FIGS. 1, 4 and 5 show a first and most basic side frame interconnection 10 in accordance with this disclosure. In this embodiment, a longer wall frame 11 is attached perpendicularly to a narrower wall frame 12 using the first side frame interconnection 10. Each of the wall frames 11 and 12 includes a pair of rectangular cross section tubular side frame members 13 to which are welded a horizontal tubular top frame member 14 and a tubular bottom frame member 15. The longer wall frame 11 may include an intermediate cross frame member 16 for additional strength and rigidity. Apart from variations in length, the side frame members 13 are essentially the same, and the top, bottom and intermediate cross frame members are also substantially the same. In one embodiment, the side frame members 13 have 1 inch×2 inches cross sections. The tubular top, bottom and intermediate frame members 14-16 have nominal cross sections of 1 inch×1½ inches.

Identical first side frame interconnections 10 are used to connect the wall frames 11 and 12 at their top and bottom ends. The side frame members 13 are connected with the narrow face 17 of one side frame member in abutting contact with the wide face 18 of the other side frame member 13. A threaded insert 20 has coaxial threaded bores 21 on opposite ends and has a generally rectangular body adapted to fit snuggly in the rectangular open end 22 of the side frame member 13. Both the threaded bores 21 in the insert 20 may be tapped; however, it is preferable to make the insert of plastic material and press a nut 23 into counterbores on opposite ends of the insert. The insert body is provided with a series of parallel thin flexible flaps 24 which deflect upon insertion of the insert and hold the insert tightly in place. A flat top 25 on the insert provides a suitable closure.

Figure 7:
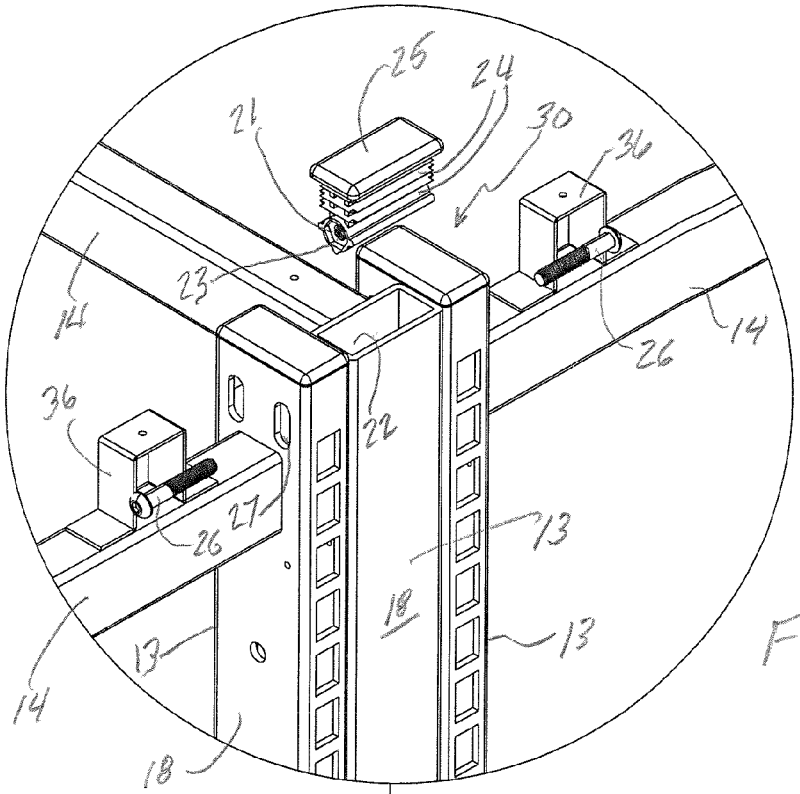
FIG. 7 is an enlarged detail of the connection shown in FIG. 6.

With the insert in place, a machine screw 26 is inserted through suitable holes 27 in the wide faces 18 in one side frame member 13 and an aligned hole 28 in the narrow face 17 of the abutting side frame member 13. The machine screw 26 is suitably tightened and the provision of an identical connection at the bottom ends of the side frame members 13 provide a rigid and secure connection. Referring briefly to FIG. 7, the holes 27 in the wide face 18 of the side frame member can be elongated, as shown, for adjustment purposes.

Although the arrangement of the various side frame members 13, inserts 20, and machine screws 26 vary in positioning from one interconnection to the others, the inserts 20 are all identical and the machine screws 26 are also all identical.

Figure 2:
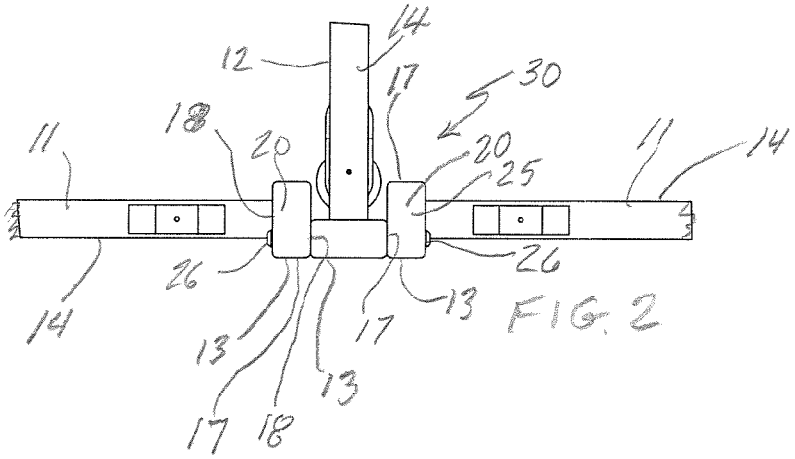
Figure 6:
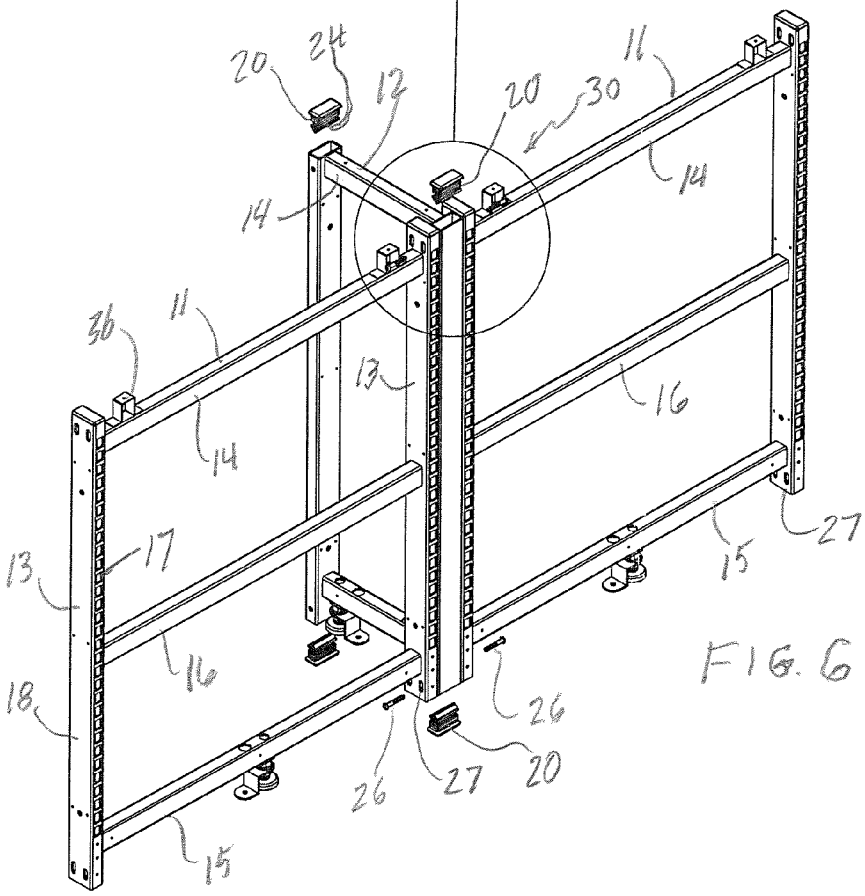
FIG. 6 is a perspective view of another wall frame subassembly utilizing the interconnection of FIG. 2.

FIGS. 2, 6 and 7 show a second side frame interconnection 30 that is an extension of the interconnection 10 of the previously described embodiment. The second side frame interconnection 30 utilizes an additional longer wall frame 11 and the two longer wall frames are separated by and attached to a side frame member 13 of a narrower wall frame 12. The second side frame interconnection 30 of this embodiment, in addition to the longer wall frame 11, requires only an additional pair of identical machine screws 26 for the upper and lower connections. The same insert 20 is used in this embodiment with the machine screw 26 extending through the elongated holes 27 in the wide face 18 of the side frame member 13 of the newly added wall frame 11. In other words, beginning with the first side frame interconnection 10, the conversion of that interconnection to the second side frame interconnection 30 requires only the addition of an upper and a lower machine screw 26.

Figure 3:
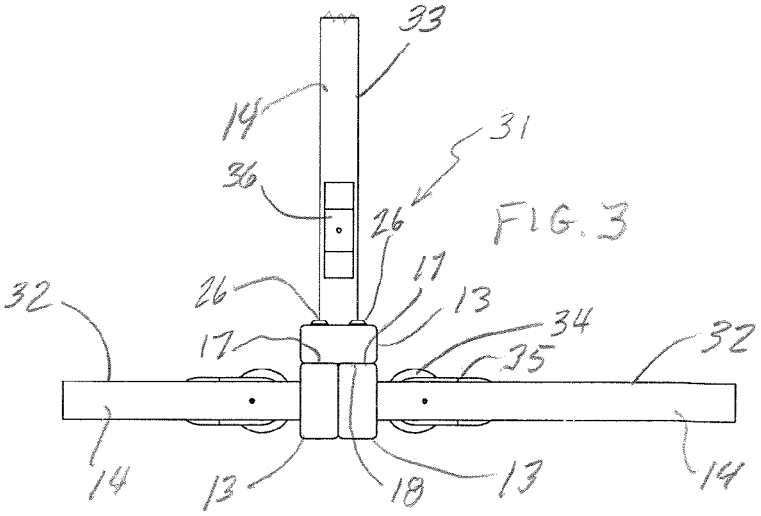
Figure 9:
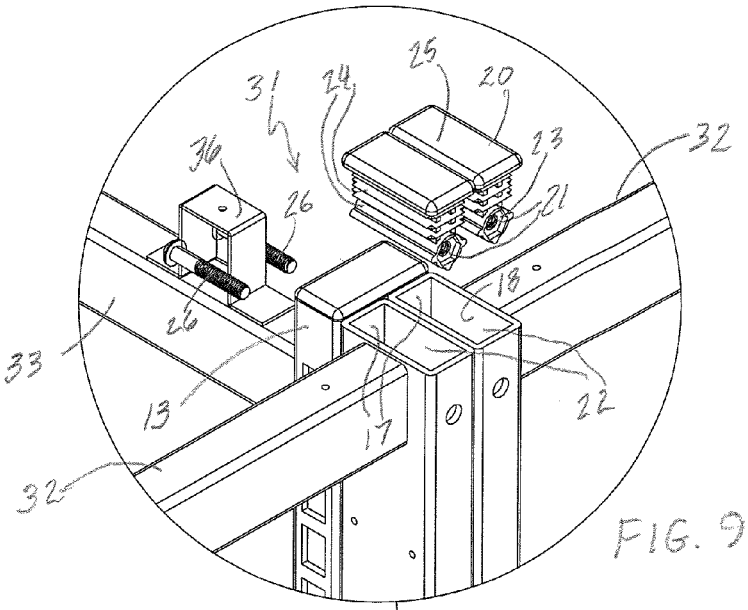
FIG. 9 is an enlarged detail of the connection shown in FIG. 8.
Figure 8:
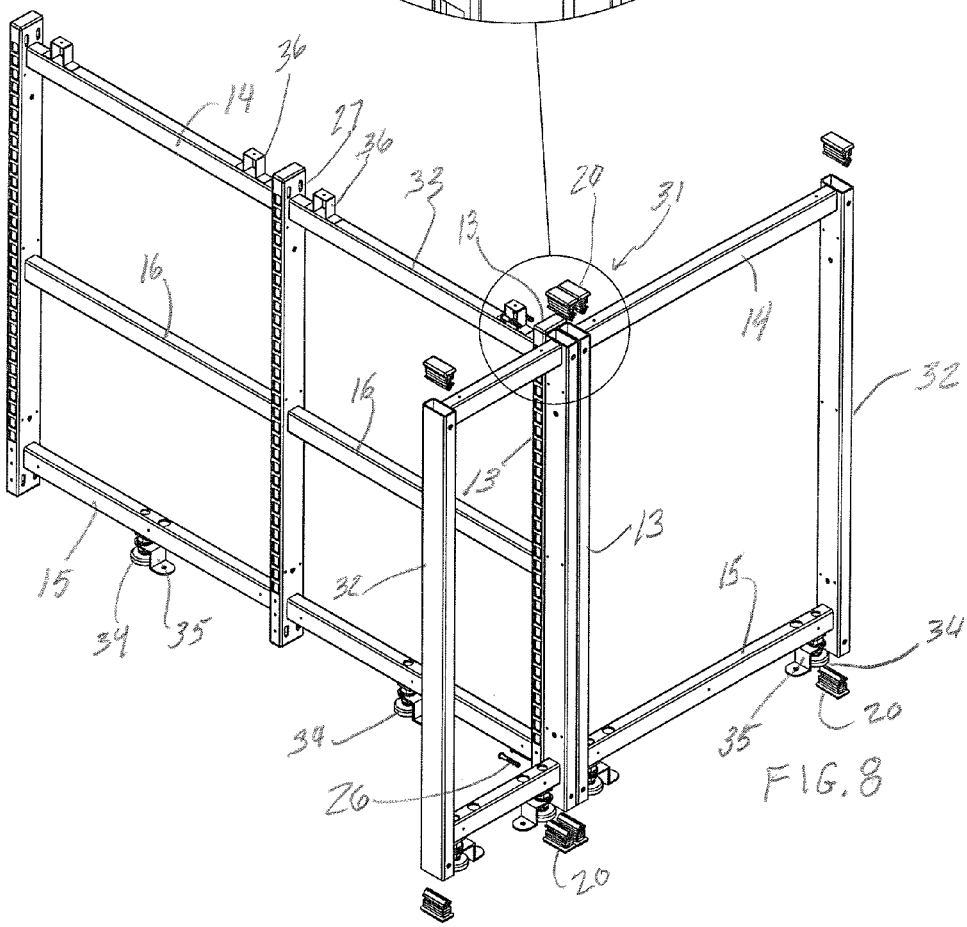
FIG. 8 is a perspective view of a wall frame subassembly using the interconnection of FIG. 3.

In FIGS. 3, 8 and 9, there is shown a third side frame interconnection 31 that, again, utilizes components that are identical to those used in the interconnections 10 and/or 30 described above. In this embodiment, two shorter wall frames 32 are connected to one leg of a double panel wall frame 33. In addition, wide faces 18 of the side frame members for the shorter wall frames 32 are positioned in abutting contact. A pair of inserts 20 are inserted into the open ends 22 of the abutting wide faces 18 and a pair of machine screws 26 extends through the wide faces of the side frame member 13 of the double panel wall frame 33 and into the threaded bores 21 of the pair of inserts 20. An identical pair of machine screws 26 cooperate with an insert pair 20 at the bottom of the interconnection in the same manner.

The tubular bottom frame members 14 of the wall frames 11, 12, 32 and 33 of each of the three interconnection embodiments may include vertically adjustable leveling pads 34 that are threaded into suitable brackets 35 attached to the undersides of the bottom frame members 15. Also, in order to accommodate the support and connection to top surfaces, such as countertops (not shown), the tubular top frame members 14 of certain of the frames 11, 12, 32 and 33 may be provided with riser brackets 36 to provide additional support for a top panel to provide a top cap close out and upper surface that is flush with the flat tops 25 of the threaded inserts 20.

Figure 10:
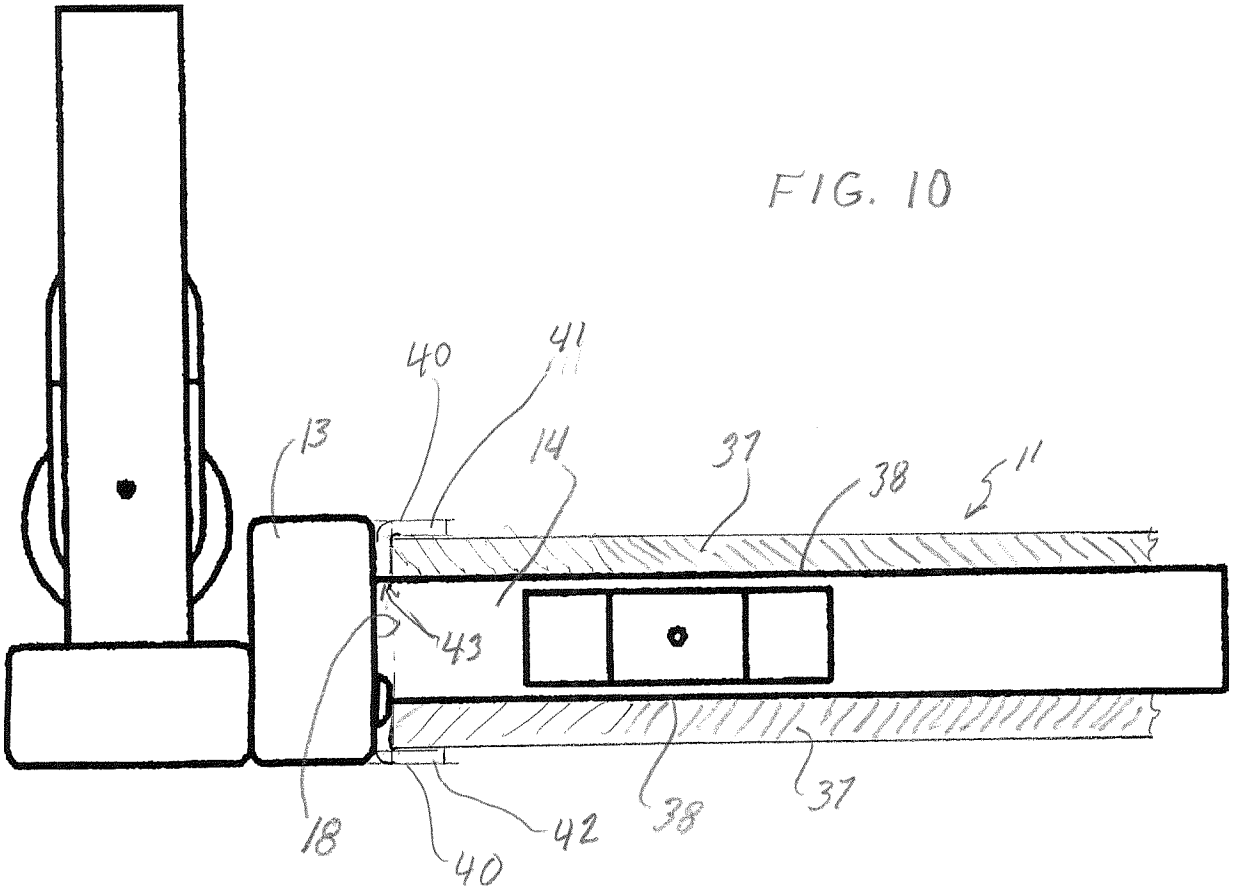
FIG. 10 is an enlarged top plan view similar to FIG. 1 showing the construction and attachment of closure panels to the rectangular frame.

Referring to FIG. 10, there is shown a modified version of FIG. 1 in which the longer wall frame 11 is provided with a pair of frame closure panels 37. Although two panels are used in this embodiment, only one is necessary to provide a desired closure. Otherwise, the panels are mounted to the frame in an identical manner.

The frame closure panels 37 extend between the wide faces 18 of the side frame members 13 and are held in position against side faces 38 of the tubular top frame member 14 and tubular bottom frame member 15. To provide a guide and securement for the closure panels 37, a pair of vertical angle members 40 are attached to the wide faces 18 of opposed side frame members 13 and extend vertically between the top and bottom frame members 14 and 15. The free unattached leg 41 of the angle members provide tongues 42 that are spaced laterally from the frame member side faces 38 to define a slot 43 into which a frame closure panel 37 is inserted vertically to provide the closure. The other leg 44 of the angle member may be attached to the face of the side frame member 13 with any suitable fasteners. To support the closure panel, a bottom stop 45 extends horizontally from the wide faces 18 of side frame members 13 at the bottom of the slot 43.

Figure 11:
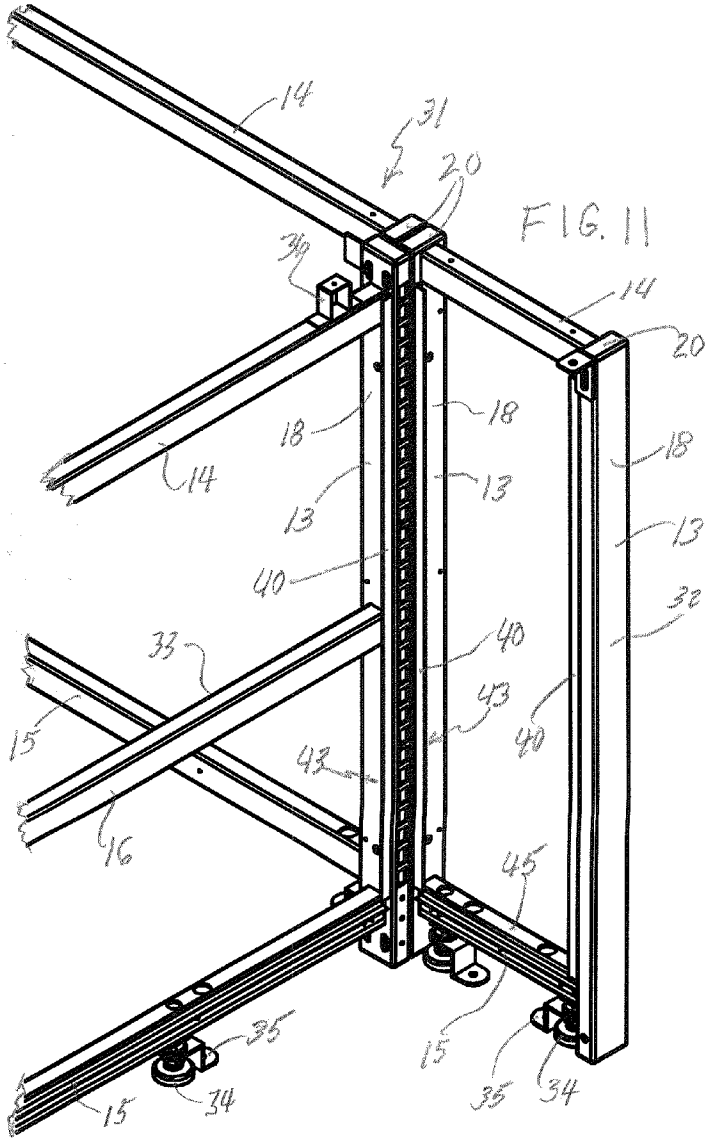
FIG. 11 is another perspective view of the side frame assembly 31 of FIG. 8 rotated 90°.
Figure 12:
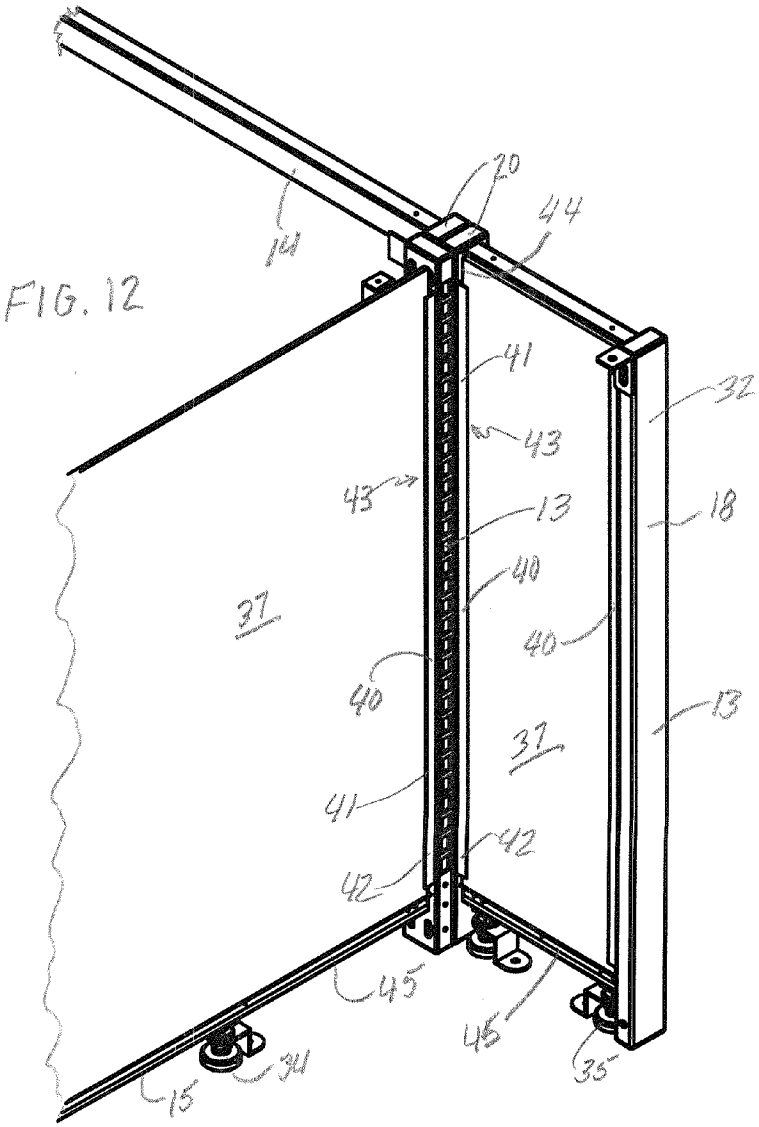
FIG. 12 is a perspective view similar to FIG. 11 showing the positioning of frame closure panels.
Figure 13:
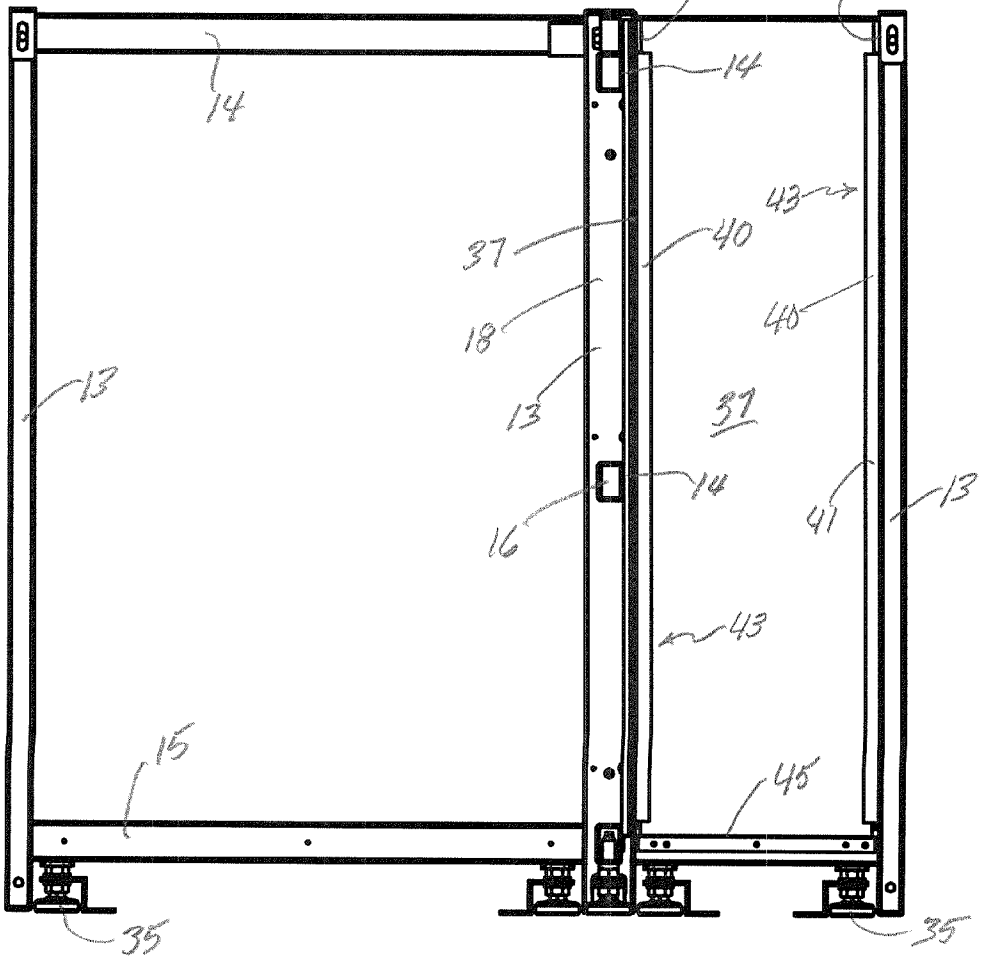
FIG. 13 is a side elevation view of the arrangement shown in FIG. 12.

FIG. 11 is similar to FIG. 8 and shows a perspective view of a frame assembly using the side frame interconnection 31 of FIGS. 3, 8 and 9. However, the side frame assembly 31 of FIG. 11 also includes the vertical angle members 40 that are attached to the wide faces 18 of the side frame members 13 in a manner similar to that shown in FIG. 10. The free legs 41 of the angle members 40 define vertical slots 43 into which closure panels 37 are inserted as shown in FIGS. 12 and 13. The other legs 44 of the angle members 40 are attached to the wide faces 18 of the side frame members 13 between which the closure panels 37 extend.

As is best seen in FIGS. 12 and 13, each of the closure panels 37 has a back side supported against the frame members 13, 14 and 15 (as well as intermediate cross frame members 16, if used). The front face of the closure panels are, as discussed above, supported in the slots 43 and against the free legs 41 of the angle members 40. A bottom stop 45 in each frame panel provides a stop and support for the closure panels 37.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

What is claimed is:

1. A connection system for joining rectangular wall frames fabricated from pairs of rectangular cross section tubular side frame members and tubular top and bottom frame members, the system comprising:

at least two side frame members from two frames positioned with a narrow face of one side frame member in abutting contact with a wide face of the other side frame member;

a side frame interconnection comprising an insert captured in the open end of said one side frame member, the insert having coaxial threaded bores on opposite ends, one of said bores adapted to receive a machine screw extending through both wide faces of the other side frame member, the narrow face of said one side frame member, and into the threaded bore at one end of the insert.

2. The invention as set forth in claim 1, including a third frame positioned with a wide face of a third side frame member in abutting contact with the narrow face of said one side frame member;

a third side frame interconnection comprising a second machine screw extending through both wide faces of said third side frame member, through the abutting narrow face of said one side frame member, and into the threaded bore at the other end of the insert.

3. The invention as set forth in claim 1, including a third frame positioned with a wide face of the third side frame member in abutting contact with the wide face of said one side frame member;

a third side frame interconnection comprising a second insert captured in the open end of said third side frame member, the second insert being identical to said first named insert;

a second machine screw identical to said first named machine screw, extending parallel thereto and through both wide faces of the other side frame member, through the narrow face of said third side frame member, and into the threaded bore at one end of said second insert.

4. A connection system for joining rectangular wall frames fabricated from pairs of rectangular cross section tubular side frame members and tubular top and bottom frame members, the system comprising:

three side frame members from three frames joined with two of said side frame members positioned with their wider faces parallel to one another and interconnected by one side frame member;

the interconnection comprising an insert captured in open ends of each of said two side frame members or said one side frame member, the insert having coaxial threaded bores on opposite ends adapted to receive pairs of identical machine screws;

the screws extending through said one side frame member and into the threaded bores of inserts in the ends of said two side frame members or through said two side frame members and into the threaded bores of the insert in the end of said one side frame member.

5. The invention as set forth in claim 4, wherein said two side frame members are positioned in face-to-face contact with their narrow faces lying coplanar, and the wide face of said one side frame member in overlying contact with said narrow faces.

6. The invention as set forth in claim 4, wherein said two side frame members are separated by said one side frame member with the opposed wide faces of said two side frame members in contact with the opposite narrow faces of said one side frame member captured therebetween.

7. The invention as set forth in claim 4, wherein the frames are fabricated with weldments.

8. The invention as set forth in claim 4, wherein the wide faces of the side frame members are wider than the wide faces of the top and bottom frame members.

9. The connection system as set forth in claim 1, including a rectangular frame closure panel placed to extend between the wide faces of opposed side frame members of one frame and with a panel back face in contact with and extending between the side faces of the top and bottom frame members.

10. The connector system as set forth in claim 9, including a pair of narrow tongues attached to the wide faces of the opposed side frame members and extending between the top and bottom frame members, the tongues defining with the side frame members a slot of receipt of the closure panel.

11. The connection system as set forth in claim 10, wherein the tongues comprise the freely extending legs of angle members the other legs of which are attached to the wide faces of the opposed side frame members.

12. The connection system as set forth in claim 11, wherein the frame closure panel is mounted in contact with the outer side faces of the top and bottom frame members.

13. The connection system as set forth in claim 12, comprising a second frame closure panel mounted in contact with the inner side faces of the top and bottom frame members.

14. The connection system as set forth in claim 12, including a bottom stop supporting the lower edge of the closure panel at the lower end of the slot.

* * * * *